United States Patent [19]

Jensen et al.

[11] 4,166,434

[45] Sep. 4, 1979

[54] VERTICAL TUBE FIRED HEATER AND PROCESS

[75] Inventors: Robert H. Jensen, Clarendon Hills, Ill.; J. Wayne Morris, Wheeling, W. Va.

[73] Assignee: UOP Inc., Des Plaines, Ill.

[21] Appl. No.: 775,232

[22] Filed: Mar. 7, 1977

[51] Int. Cl.[2] ..... F22B 21/30

[52] U.S. Cl. ..... 122/356; 165/109; 122/275

[58] Field of Search ..... 165/109; 196/110, 125; 122/356, 501, 275

[56] References Cited

U.S. PATENT DOCUMENTS

| | | | |
|---|---|---|---|
| 1,683,766 | 9/1928 | Egloff et al. | 196/125 |
| 1,887,155 | 11/1932 | Harnsberger | 196/125 |
| 1,910,242 | 5/1933 | Chittick | 196/125 |
| 2,318,206 | 5/1943 | Eisenlohr | 165/109 |
| 2,709,128 | 5/1955 | Krause | 165/109 |
| 2,964,033 | 12/1960 | Throckmorton et al. | 126/356 |
| 3,572,296 | 3/1971 | Carson et al. | 122/275 |
| 3,687,116 | 8/1972 | Holt | 122/356 |

*Primary Examiner*—Kenneth W. Sprague

*Attorney, Agent, or Firm*—James R. Hoatson, Jr.; John F. Spears, Jr.; William H. Page, II

[57] ABSTRACT

The scaling of the internal surfaces of vertical downflow fired heater tubes is decreased by a vapor-liquid mixing means located in the straight section of the tubes which have downward flow.

4 Claims, 6 Drawing Figures

VERTICAL TUBE FIRED HEATER AND PROCESS

FIELD OF THE INVENTION

The invention relates to the design of fired heaters used to heat mixed-phase vapor-liquid streams. The invention more specifically relates to an apparatus and process for heating fluids in which the fluids are passed downward through substantially straight tubular conduits.

PRIOR ART

Vertical tube fired heaters are an established apparatus used to effect the heating or vaporization of various fluids in a wide number of industrial applications. These heaters are used to heat feed streams to reaction zones and fractionation columns, to heat heavy petroleum fractions for visbreaking operations, in thermal reforming and in thermal cracking operations, etc. Those skilled in the art are therefore capable of designing, building and operating such heaters.

Examples of the prior art are contained in U.S. Pat. Nos. 3,274,978 (Cl. 122—356); 3,566,845 (Cl. 122—240); 3,572,296 (Cl. 122—275); 3,667,429; 3,687,116; 3,841,274; and 3,882,826 (Cl. 122—333). These references illustrate the use of straight sections of tubular heat exchange conduit within an enclosed radiant heating chamber having a plurality of burners. It is believed that heretofore the vapor and liquid phases which were passed downward through the conduits were not admixed within the tubes by elements specifically designed for this purpose.

BRIEF SUMMARY OF THE INVENTION

The invention provides an apparatus and process for the high temperature heating of vapor-liquid mixtures wherein the recurring problem of scaling within straight vertical heater tubes is reduced. This improvement is accomplished by admixing the liquid and vapor phases which are traveling downward through the tubes in order to prevent the establishment of an annular flow regime within the tubes. Preferably, two or more vapor-liquid mixing means are placed at intermediate points within the tubes carrying the mixed-phase stream in a downward direction.

DESCRIPTION OF THE DRAWING

Referring now to FIG. 1, there is shown a fired heater such as may be used in various petroleum heating operations. The basic outer structure of the heater is formed by a horizontal floor 3 which abuts a pair of vertical sidewalls 2 and 2'. The floor and sidewalls are rectangular and planar. A second pair of opposing sidewalls forms the other two sides of the heater. The inner surfaces of these walls are covered by a continuous layer of a suitable refractory material 5 chosen for its insulating ability, physical strength, ability to withstand high temperatures, etc. Surface 7 is the inner surface of this layer upon the back sidewall of the heater. This heater has a roof section which completes the enclosure of a radiant heating chamber 8. A vent 28 for the flue gases is shown to be centrally located, but may be offset or located at a lower elevation as in other furnace structures known in the art.

Figure 6:
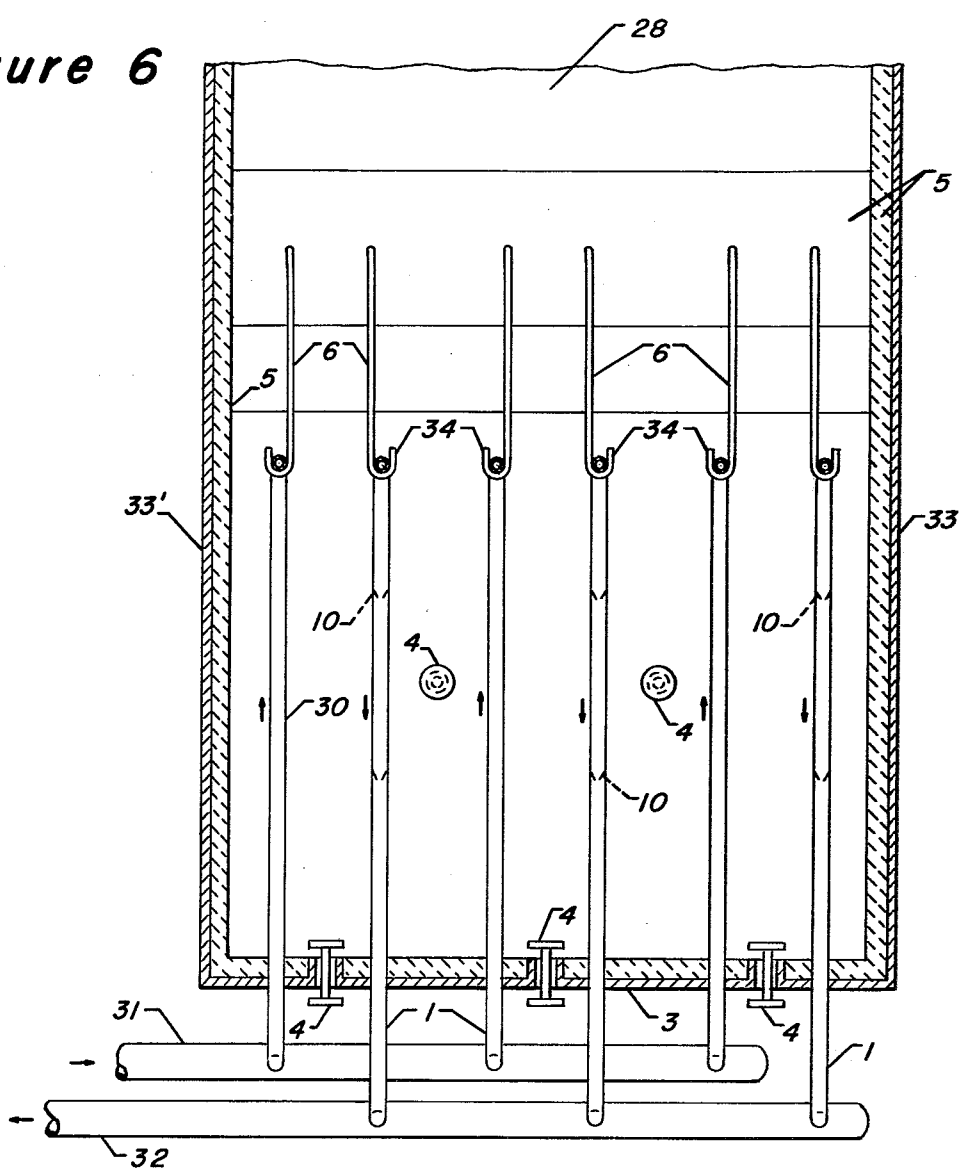
FIG. 6 is a cross-sectional view of the furnace of FIG. 1 taken along plane 6—6.

A heater tube 1 enters the heater through the floor. It may alternatively enter the radiant heating chamber from a convection heating chamber located above or beside the radiant heating chamber. This tube carries a mixed-phase vapor-liquid stream from an external inlet manifold section 31. A plurality of such tubes is employed within the heater, but the other tubes are hidden from view because of their alignment in back of tube 1. This tube has a first straight section 30 which carries the mixed-phase stream upward. It is then directed horizontally through the upper portion of the radiant heating chamber to a second straight section 30' of the heater tube. The horizontal section of each pass of the tube is hung from two support brackets 6. Each support should be adapted to allow for the upward movement of the tube caused by thermal expansion when the heater is in operation. The bottom of the second straight section terminates in a U-shaped curve at 9 which directs the mixed-phase stream to another vertical straight section located behind section 30'. This bottom portion of the tube rests on a tube support and positioner 29. Additional brackets or braces may be used to maintain the tubes in proper alignment. Two vapor-liquid mixing devices 10 are attached to the inner surface of the downflow section 30' of the heater tube. These mixing devices function to break up the annular liquid flow along the inner surface of the tube. A plurality of burners 4 is located in rows in the floor and sidewalls of the heater to provide the flames used for heating the tubes. The outlet end of the heater tube is connected to a fluid outlet manifold 32.

Figure 2:
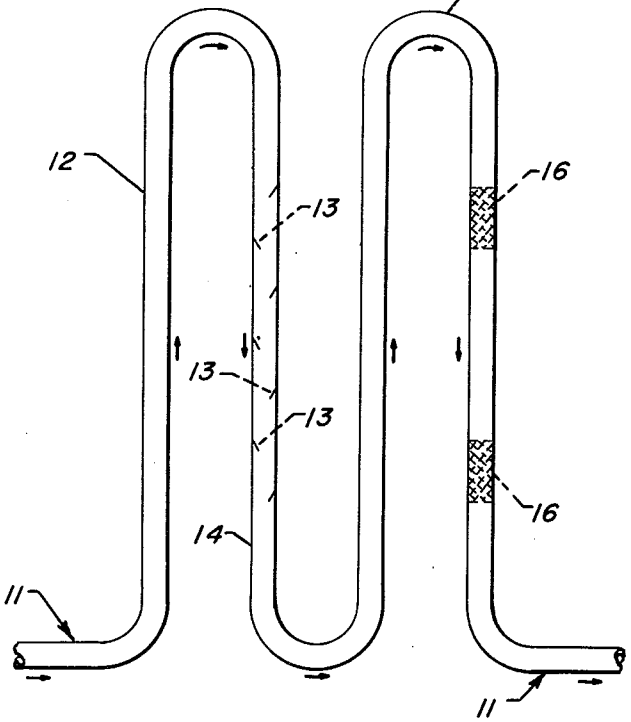
FIG. 2 is a diagrammatical view of a heater tube containing two different types of vapor-liquid mixing means.

In FIG. 2 one possible configuration of a heater tube 11 is shown in greater detail. A mixed-phase process stream enters the bottom of straight section 12 and passes upward. A curvilinear section 15 directs the process stream downward into a second straight section 14. A series of sloping vapor-liquid mixers 13 is spaced at regular intervals along the inner surface of this section of the tube. These mixers are vertically staggered on opposing sides of the tube in an effort to minimize the problems associated with the differing amounts of thermal expansion due to the different temperatures of the mixers and the tube surface during operation of the heater. Preferably all of the mixers within a single heater tube are of the same type. However, for purposes of illustration a different type of mixer 16 is shown in the far right-hand straight section of tube 11. These mixers are short sections of commercially available static mixers comprised of several layers of spiral shaped helices which divide and remix the process stream several times within the mixer. This is the preferred type of mixer.

Figure 1:
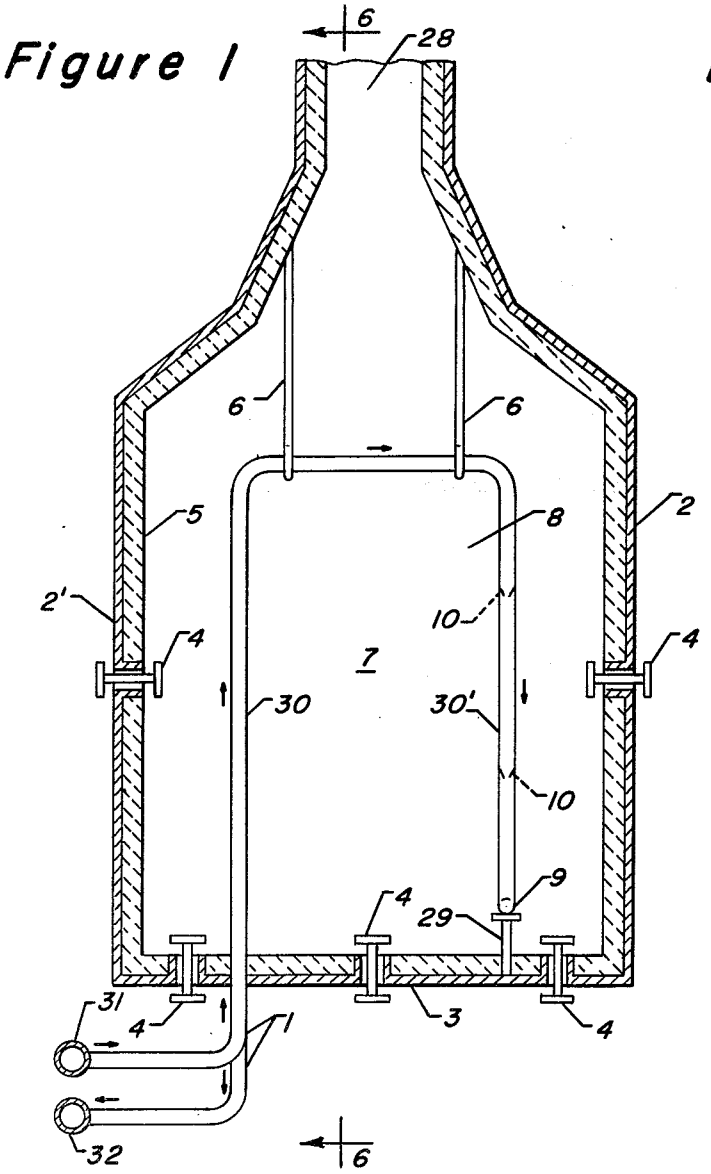
FIG. 1 is a cross-sectional view of a furnace for the radiant heating of mixed phase fluids which employs the invention.
Figure 3:
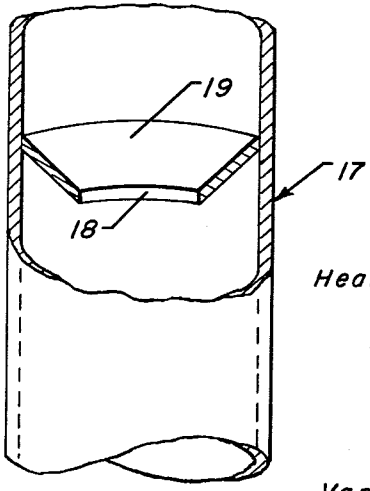
FIG. 3 is a cross-sectional view of a third type of vapor-liquid mixing means within a heater tube 17.

FIG. 3 presents a more detailed view of the vapor-liquid mixer shown in FIG. 1. This mixer is circular when viewed from above and has the appearance of a ring abutting the inner surface of heater tube 17. It extends completely around this inner surface. The downward sloping upper surface 19 of the mixer causes liquid flowing along the inner surface of the tube to pass through a centrally located orifice 18 wherein it is remixed with the vapor phase passing through the tube. Preferably, the orifice is circular and of a diameter which does not provide a high pressure drop.

Figure 4:
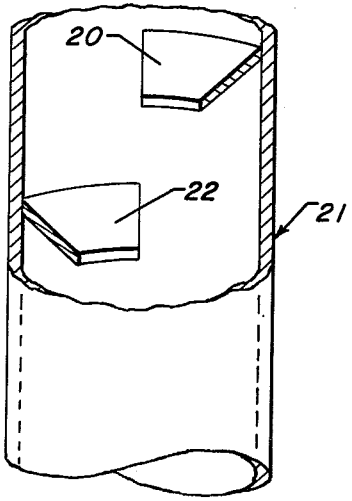
FIG. 4 is a cross-sectional view of a straight section of heater tube containing two vapor-liquid mixing means 20 and 22 similar to elements 13 of FIG. 2.

The vapor-liquid mixing devices 20 and 22 of FIG. 4 are similar to those shown in tube section 14 of FIG. 2. These mixers are preferably semi-circular when viewed from above to sweep liquid from about 180° of the inner surface of the tube. The angle between the radially directed edges of the mixer may, however, vary from about 90°–270°. The attachment of the mixers to the inner surface of heater tube 21 is staggered at different vertical elevations as illustrated to minimize pressure drop.

Figure 5:
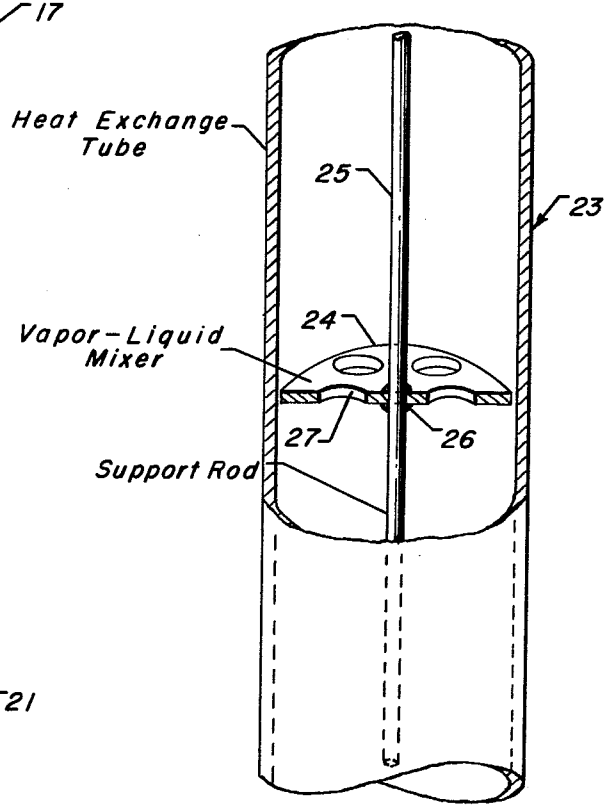
FIG. 5 is a cross-sectional view of a fourth type of vapor-liquid mixing means which is suspended within a heater tube 23.

In FIG. 5 the vapor-liquid mixer 24 is a perforated circular plate suspended from, or alternatively supported by, a vertical centrally located rod 25. This rod is aligned along the central vertical axis of the heater tube 23. The mixer is held horizontal by welds 26. The perforations 27 of the mixer may have many configurations, but they are divided by the radially extending arms of the mixer which are necessary to support its outer wall wiping portion.

FIG. 6 shows the same furnace or heater as FIG. 1 from a different angle. The fluid inlet conduit 31 and the fluid outlet conduit or manifold 32 are more clearly shown in this view. The preferred heater tube structure is also more evident. Each tube 1 enters through the floor 3 and has a first straight section 30. It then extends horizontally through the upper portion of the furnace to a second straight section not shown which carries the process fluids in a downward direction. The vertical and horizontal sections of the tube are preferably joined by curvilinear sections. The process fluids then pass upward again through a third straight section and once again pass downward through a fourth straight section which is connected to outlet manifold 32. Both downflow sections of the heater tube have vapor-liquid mixers 10. This view shows the second pair of opposing side walls 33 and 33' which enclose the radiant chamber. The lower ends of the tube supports 6 preferably end in a U-shaped hook 34 which is adapted to guide the vertical movement of the tubes.

The Drawing is intended to illustrate the preferred embodiment of the invention and some possible variations. It is not intended to preclude from the scope of the invention those other embodiments set out herein or which are the result of reasonable and normal modification of these embodiments.

DETAILED DESCRIPTION

A great many petroleum, petrochemical and chemical industry processes require the use of fired fluid heaters wherein there is a large heat flux across the heat exchange tube surface. In many of these applications the effectiveness of the heating operation gradually decreases due to the buildup of scale upon the inner surface of the tubular conduits used as heat exchangers within the furnace. This scale formation is detrimental for at least two reasons. First, it acts as a layer of insulation which cuts down the effective thermal conductivity of the tube, thereby making the heat exchange operation less efficient. Secondly, the tubes are often exposed to a very high temperature heat source which could cause the tubes to soften or actually melt if it were not for the rapid heat removal by the process stream being heated. This may lead to the failure of the tube as by bursting under the pressure of the process stream. Furthermore, if the scale reaches an excessive thickness, the heater must be shut down. This potential interruption of the on-stream operation of an industrial process is very undesirable.

The removal of the scale buildup is not an easy or fast operation. Various techniques are known which utilize high velocity fluid streams to cut or loosen the scale. Mechanical means may also be used to scrape or cut off the scale. If the scale is carbonaceous in character it may be removed by controlled combustion utilizing a mixture of steam and air. However, all of these methods are time-consuming and do not solve the actual problem of scale deposition.

It is an objective of this invention to provide an apparatus and process for the indirect heating of mixed-phase vapor-liquid streams in vertical tube fired heaters. It is a further objective of this invention to provide a means to reduce scaling in downflow tubes used to heat vapor-liquid mixtures.

Those skilled in the art are aware of the fact that scale deposits do not form a uniform layer on the inner surface of the heat exchange tubes. For instance, previously cited U.S. Pat. No. 3,687,111 recognizes that uneven coking may occur in the tubes and cause them to contort into shapes other than that originally designed. Independently, it has now been observed that scaling is less likely to occur within a tube carrying a mixed-phase stream in an upward direction. It has also been observed that scaling within a downflow tube is not as great in the upper regions of the tube as in the lower regions of the tube.

These observed phenomena can be correlated to a limited extent with the type of flow regime which is thought to be present within the heater tube at these specific locations. In the upflow sections of the heater tubes the predominant flow regime is slug flow. This type of flow typically comprises slugs of gas which are surrounded by a thin liquid annulus which occur between periods during which the gas is dispersed as discrete bubbles. It may therefore be described as one in which the liquid and vapor phases are being admixed and do not tend to separate. The liquid adjacent the wall is well agitated. In contrast, the predominant flow regime in downflow annular tubes is believed to be annular flow. This type of flow is characterized by phase separation, with the liquid phase tending to form an annular coating on the inner surface of the heater tube, while the vapor phase separates into a cylindrical stream flowing through the center of the heater tube.

It is believed that the presence of an annular flow regime promotes the formation of scale in the heater tubes, whereas a slug flow or turbulent flow regime discourages scaling. In annular flow a relatively slow moving layer of liquid is in constant contact with the inner surface of the tube. It is, therefore, exposed to the high skin temperatures which promote scale forming reactions for a longer period of time. The temperature of the liquid which is in contact with the inner surface is likely to be higher in an annular flow regime because the less turbulent liquid flow results in a lower rate of heat removal from the surface of the tube. The observed low scaling rate at the top of downflow tube sections is believed to result from entrance effects which admix the vapor and liquid phases.

The invention comprises a method to lessen the formation of scale by preventing annular liquid flow in the downflow heater tubes. Therefore, a broad embodiment of the invention is a method of heating a mixed-phase process stream which comprises the steps of passing the process stream into the upper end of a straight vertical section of a heater tube which is maintained at a high temperature, passing the process stream downwardly through the straight section and admixing the vapor and liquid phases at at least one point between the upper and lower ends of the straight section of the heater tube by passing the process stream through a vapor-liquid mixing means. Preferably, this mixing means is located in the lower 70% of the straight section. In a more limited embodiment two or more vertically staggered mixers are provided.

This method of heating is carried out at high temperatures in the range of about 500° F. to about 1500° F. or above. Moderate superatmospheric inlet pressures in the range of 5 to 200 psig. are preferred, but the process may be practiced at pressures both above and below this range. The process stream fed into the heater tube preferably contains at least 15 vol.% liquid and at least 15 vol.% vapor. The total residence time of the process stream in the radiant chamber of the heater is preferably in the range of from about 2 to 150 seconds. The vapor phase may comprise light hydrocarbons such as methane, propane or butane, or normally liquid hydrocarbons such as benzene, heptane, nonane, decane, xylenes and ethylbenzene and other alkylaromatic hydrocarbons. Hydrogen, steam, carbon dioxide and carbon monoxide may be present in the vapor phase. The liquid phase will typically comprise relatively high boiling hydrocarbonaceous materials, that is those petroleum, shale or coal derived materials having atmospheric boiling points above about 500° F. as determined by the appropriate ASTM distillation. The liquid phase may therefore be a middle or heavy distillate such as a fuel oil, kerosene or atmospheric gas oil, a topped crude oil, a vacuum column bottoms, a coal liquefaction or oil shale product stream and other similar materials.

The invention is limited to practice with mixed-phase process streams. As used herein the term "mixed phase" is intended to indicate the presence of a liquid phase portion and a vapor phase portion within the process stream. The invention is further limited to practice in substantially straight vertical heater tubes in which the liquid is flowing downward. As used herein the term "scale" is intended to refer generically to any undesirable solid coating which adheres to the inner surface of the heater tube and which is formed from the exposure of some component of the process stream to high temperatures.

The apparatus used to perform the subject process may have many various configurations. This fact is demonstrated by the different structures shown in the previously cited references. For instance, although the flue is normally centrally located in the roof section covering the radiant chamber, U.S. Pat. No. 3,841,274 teaches the withdrawal of the flue gas through mid-height openings in the sidewalls. These references also teach that the burners may be located in the floor, sidewalls and roof of the heater. The floor of the heater is normally raised above ground level by suitable supports in order to allow access to the burners and to allow air circulation. It is contemplated that either gas or oil may be utilized as fuel to provide a high temperature flame within the radiant chamber.

The preferred arrangement of the heater will also have provision to utilize the sensible heat contained within the hot flue gases formed in the radiant heating section. This is commonly referred to as convection heating since the flue gases are often transported by convection. The draft or suction necessary for this is obtained by the use of a stack of sufficient height. Alternatively, a forced or induced draft may be used to reduce the height of the stack. Forced induction of preheated combustion air can be used to increase the flame temperature.

Perhaps the greatest variation in heater construction can be found in the structure of the heater tubes and their required supports. The cold process stream is normally distributed to a large plurality of heater tubes by a distributor located outside of the heater. Likewise the effluent of the tubes is collected into a central outlet means. The process stream will often pass through the convection section of the heater before entering the radiant heating section. This preheating may include passage through horizontal heater tubes. The process stream may make only a single downward passage through the radiant section as taught in U.S. Pat. No. 3,882,826. More commonly the process stream will pass through a heater tube having at least one curvilinear section which causes the process stream to make two or more vertical passes through the heater. These passes will alternate between upflow and downflow. For instance, U.S. Pat. No. 3,667,429 presents an apparatus in which the process stream makes one upward passage and one downward passage through straight sections of a heater tube. In this reference the curvilinear sections produce relatively square corners. In contrast, the two pass apparatus of U.S. Pat. No. 3,572,296 presents a gentle circular section which is used to change the direction of flow of the process stream. U.S. Pat. No. 3,687,116 shows a four pass heater tube having two straight downflow sections. U.S. Pat. Nos. 3,572,296 and 3,566,845 present serpentine heater tube designs providing a large number of upflow and downflow passes in a single heater tube. Those skilled in the art may select both the proper size and metallurgical composition of the heater tube. The process stream may enter and leave at either the top or the bottom of the radiant section. In the petroleum industry the tubes will normally have an inside diameter of from about 2 to about 6 inches, but the invention may be applied to tubes having diameters outside this range.

The vapor-liquid mixing means used within the heater tubes is also subject to much structural variation. It must be capable of removing liquid from the inner surface of the tube and admixing it with the vapor phase at a point near the center of the tube. Preferably, it obstructs less than 50% of the flow path through the tube and will not create a high pressure drop at the design flow rate. It must also be able to withstand the high temperatures, found within the heater tube. It may be attached directly to the inner surface of the heater tube or merely suspended upon several raised notches on the inner surface of the tube. The latter means of support allows the tube and vapor-liquid mixer to move relative to each other and thereby prevents the buildup of stress due to differing amounts of thermal expansion.

A third method of installing the mixers is to utilize a support rod as shown in FIG. 5. This rod may rest on the bottom of the tube, but preferably it hangs from an upper portion of the heater tube. One method of hanging the rod is to wedge a narrow sloping bar between a raised nub on one side of the heater tube and a higher point on the other side of the tube. The support rod can then be hung from a central point along the bar. The length of the bar should be at least twice the diameter of the tube to provide a high vertical angle which will allow the upper end of the bar to move vertically relative to the tube.

There are preferably a plurality of vapor-liquid mixers provided within the heater tube. They are only placed within substantially straight sections of the tube which are intended to carry the process stream in a downward direction. The mixers are preferably vertically staggered, that is at different vertical elevations, within the lower 70% of the straight section. Their placement will, however, be set by the length of the straight section, and in very long sections they may be at higher relative elevations such as the midpoint of the tube or higher. In the preferred embodiment the mixers are two or more commercially available static mixers which are formed by vertically stacked layers of helices, with each layer having its helices offset from the helices in the layer next above by a substantial angle such as 90°. The lowermost mixer is located a substantial distance above the bottom of the straight section since the two fluid phases will be admixed at the outlet or curved section attached to the bottom of the straight section.

The preferred embodiment of the invention comprises an indirect heating apparatus which comprises a radiant heating chamber formed by a horizontal floor, a roof section and two pairs of opposing vertical sidewalls; a plurality of burners operably positioned within the radiant heating chamber along at least one sidewall; a flue gas outlet conduit communicating with the internal volume of the radiant heating chamber; a plurality of spaced apart tubular fluid conduits located within the radiant heating chamber, with each conduit having a vertically oriented first straight conduit section connected to a fluid inlet means located in a lower portion of the apparatus, the first straight conduit section extending into the upper portion of the apparatus and connected to a second straight conduit section by a curvilinear section of the conduit; a fluid outlet means connected to the fluid conduit; and at least two vertically spaced apart static vapor-liquid mixing devices located in the lower 70% of the second straight conduit section. As used herein the terms "upper portion" and "lower portion" of the apparatus are intended to refer to those portions of the apparatus which are on the respective side of a horizontal plane passing through the vertical midpoint of the radiant heating chamber. For purposes of this definition, the radiant heating chamber is not considered as extending above the lowest portion of the roof section of the heater.

We claim as our invention:

1. An apparatus for the indirect heating of mixed-phase fluids which comprises:
   (a) a radiant heating chamber formed by a horizontal floor, a roof section and two pairs of opposing vertical sidewalls;
   (b) a plurality of burners operably positioned within the radiant heating chamber;
   (c) a flue gas outlet conduit communicating with the radiant heating chamber;
   (d) a plurality of spaced apart tubular fluid conduits located within the radiant heating chamber, each fluid conduit having at least one vertically oriented downward flow straight section;
   (e) fluid inlet and fluid outlet means connected to the fluid conduits; and,
   (f) at least two spaced apart vapor-liquid mixing means located within the downward flow straight sections of said fluid conduits.

2. Apparatus according to claim 1 wherein the fluid inlet means is located in a lower portion of the apparatus and is connected to a first straight vertical section of a first fluid conduit, the first straight vertical section of the first fluid conduit extends into an upper portion of the apparatus and is connected to a second straight vertical section of the first fluid conduit by a curvilinear section of the first fluid conduit, and the vapor-liquid mixing means is located within the second straight vertical section of the first fluid conduit.

3. The apparatus according to claim 1 wherein said mixing means are located in the lower 70% of said downward flow straight sections.

4. In a process for heating a mixed-phase vapor-liquid stream by downward passage through a vertically oriented indirect heat exchange tube located within a radiant heating chamber, the improvement which comprises admixing the vapor and liquid phases of the mixed phase stream at an intermediate elevation in a mixing zone positioned within the heat exchange tube during the downward passage of the mixed phase stream through the heat exchange tube, whereby the formation of an annular flow regime within the heat exchange tube is disrupted.

* * * * *